United States Patent [19]

Bahn et al.

[11] Patent Number: 4,582,382

[45] Date of Patent: Apr. 15, 1986

[54] ELECTRICAL CONNECTOR FOR OXIDIZED SURFACE

[75] Inventors: Richard R. Bahn, Crystal; Maynard L. Thompson, Prior Lake, both of Minn.

[73] Assignee: Honeywell Inc., Minneapolis, Minn.

[21] Appl. No.: 616,321

[22] Filed: May 31, 1984

[51] Int. Cl.[4] ..... H01R 11/20

[52] U.S. Cl. ..... 339/97 R; 339/95 R

[58] Field of Search ..... 339/95 R, 96, 97, 278

[56] References Cited

U.S. PATENT DOCUMENTS 3,194,877 7/1965 Collier ..... 339/95 R 3,288,914 11/1969 Fuller et al. ..... 339/97 R

*Primary Examiner*—Gil Weidenfeld

*Assistant Examiner*—Paula Austin

*Attorney, Agent, or Firm*—Mitchell J. Halista; Trevor B. Joike

[57] ABSTRACT

An electrical connector for an oxidized surface includes a plurality of spaced apart parallel connector legs integrally formed as extensions of a central connector spine. Each connector leg has a free standing integral barb projecting therefrom toward an adjacent one of the connector legs. A group of legs is arranged to straddle a metal plate having an oxidized surface with the pointed ends of the barbs having a separation less than the thickness of the plate to enable the barbs to scrape the oxide from the surface to establish electrical contact to the underlying metal layer. The connector, in turn, is made of phosphor bronze to enable a spring-loaded electrical contact to be made to the connector surface by providing a low resistance non-oxidizing contacting surface. A use for such as connector would be to provide an effective electrical connection to aluminum plates such as those used in an electrostatic precipitator where the aluminum oxide forms an electrical current barrier and the connector is required to have a low resistance surface to contact a spring-loaded connector extending from a high voltage source to the collector plates. The use of an extended connector spine enables the connector to bridge a pair of plates while providing individual electrical connections thereto.

10 Claims, 4 Drawing Figures

ELECTRICAL CONNECTOR FOR OXIDIZED SURFACE

BACKGROUND OF THE INVENTION

Field of the Invention

This invention relates to electrical connectors. More specifically, the present invention is directed to an electrical connector for an oxidized surface.

SUMMARY OF THE INVENTION

An object of the present invention is to provide an improved electrical connector for an ozidized surface.

In accomplishing this and other objects, there has been provided, in accordance with the present invention, an electrical connector having a first group of parallel legs, each having a free standing barb on a free first end thereof, the points of said barbs being arranged in a facing relationship and having a spacing less than the thickness of a plate to be straddled by said legs, a second group of parallel legs, each having a free standing barb on a free first end thereof, said barbs on said second legs being arranged in a facing relationship and having a spacing less than the thickness of a plate to be straddled by said second legs and a longitudinal spine having said first legs attached to a first side of said spine and said second legs attached to a second side of said spine, said spine, said barbs and said first and second legs being made of an electrically conductive material.

BRIEF DESCRIPTION OF THE DRAWINGS

A better understanding of the present invention may be had when the following detailed description is read in connection with the accompanying drawings, in which.

DESCRIPTION OF THE PREFERRED EMBODIMENT

Figure 1:
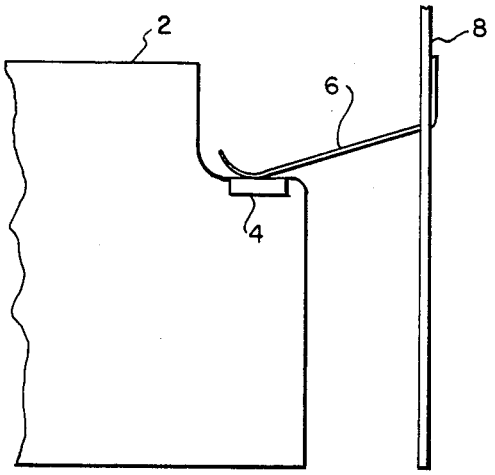
FIG. 1 is a pictorial illustration of the electrical connector of the present invention used in an electrostatic precipitator.

Referring to FIG. 1 in more detail, there is shown a partial pictorial illustration of an electrostatic precipitator having a plurality of contaminent collector plates 2. Typically, these plates 2 are made of aluminum which is normally covered with an aluminum oxide on its surface. In order to provide an effective electrical connection to the collector plates 2, an electrical connector 4 has to penetrate the aluminum oxide surface coating while presenting a low resistance surface to a spring-loaded wiping arm 6 which, in turn, is connected to a terminal board 8 for supplying a high voltage to the collector plates 2 by a power supply (not shown).

Figure 2:
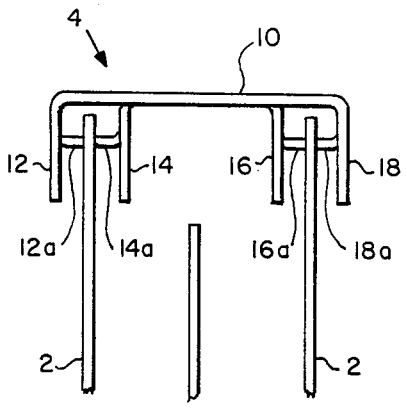
FIG. 2 is a side view of the electrical connector of the present invention used in the environment shown in FIG. 1.

In FIG. 2, there is shown a side view of the electrostatic precipitator environment shown in FIG. 1 having a plurality of collector plates 2. An embodiment of the electrical connector 4 of the present invention is arranged to bridge a pair of the collector plates 2 by utilizing a center spine section 10 having a pair of integrally formed parallel legs 12, 14 extending perpendicular to the bridge section and a similar pair of perpendicular legs 16, 18 arranged along the other side of the bridge section 10. Each of the legs 12, 14, 16 and 18 is provided with a integrally formed free-standing barb, e.g., barbs 12*a*, 14*a*, 16*a* and 18*a*.

The barbs for each pair of legs, e.g., barbs 12*a*, 14*a* for legs 12, 14, is arranged with the points of the barbs in a facing relationship and spaced apart by a distance less than the thickness of the plates 2. The barbs 12*a*, 14*a*, 16*a* and 18*a* may each be formed in the legs 12, 14, 16 and 18 by selectively shearing the metal from the respective legs. The legs and the barbs provide a means for penetrating the surface oxide coating on the aluminum plates 2 by a scraping action of the barbs as the connector 4 of the present invention is pushed onto to the collector plates 2. The connector 4 is preferably made of an electrically conductive material having a low resistance non-oxidizing surface such as phospor bronze to provide a means for effecting a low resistance electrical connection to the spring 6.

Figure 3:
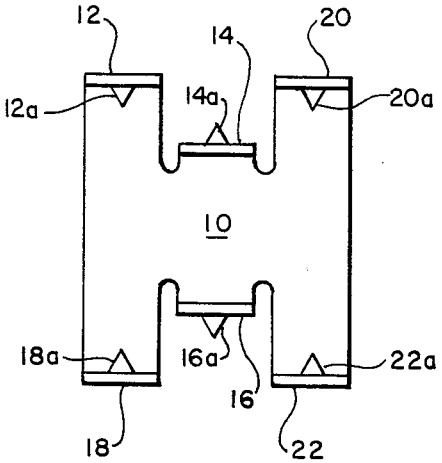
FIG. 3 is a bottom view of a second embodiment of the electrical connector of the present invention and FIG. 4 is a side view of the electrical connector shown in FIG. 3.
Figure 4:
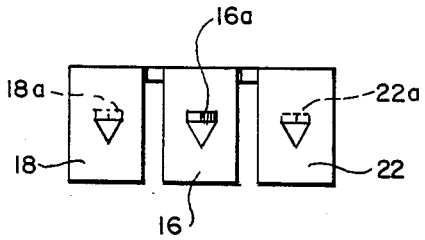

As shown in FIG. 3, a second embodiment of the connector 4 includes additional parallel legs 20, 22 along the spine 10 having respective barbs 20*a* and 22*a*. From this figure, it may be seen that legs 12 and 18 are formed at one end of the spine 10 while the legs 14 and 16 are offset from the legs 12 along the spine 10 to enable the connector legs to be integrally formed from a single piece of metal forming the connector 4. The additional legs 20,22 are parallel to the aforesaid legs 12, 14, 16 and 18 and are substantially a duplicate of the legs 12 and 18 although located at the other end of the spine 10 from the legs 12 and 18. Accordingly, each group of legs, e.g., legs 12, 14 and 20 is arranged to straddle one of the plates 2 while the corresponding barbs 12*a*, 14*a* and 20*a* are arranged to penetrate the plate's surface oxide. Similarly, the other group of legs 16, 18 and 22 provide a similar function with respect to an adjacent one of the plates 2. The additional barbs 20*a* and 22*a* on the additional legs 20 and 22 provide an additional oxide penetrating surface and also balance the offset relationship of the legs 12, 14, 16 and 18 along the spine 10 to facilitate the mounting of the connector 4 on the plates 2 by assisting the locating of plates 2 between the legs during the mounting of the connector 4 on the plates 2. In FIG. 4, there is shown a side view of the connector shown in FIG. 3. In summary, the attachment of the connector 4 to the collector plates 2 provides a high unit force contact to penetrate the aluminum oxide by a scraping action which further assures a continued good electrical connection by preventing an oxide build-up between the connector and the underlining metal layer. Concurrently, the non-oxidizing surface of the connector 4 presents a low-resistance connection to a spring-loaded wiper arm 6.

Accordingly, it may be seen, that there has been provided, in accordance with the present invention an improved electrical connector for an oxidized surface.

The embodiments of the present invention in which an exclusive property or privilege is claimed are defined as follows:

1. An electrical connector comprising a first group of parallel legs, each of said legs having a free standing pointed barb on a free first end thereof, the points of said barbs on adjacent legs being arranged in a mutually facing relationship and having a spacing in the direction of the facing relationship less than the thickness of a plate to be straddled by said legs, a second group of parallel legs, each of said legs in said second group having a free standing pointed barb on a free first end thereof, the points on said barbs on adjacent legs on said second legs being arranged in a mutually facing relationship and having a spacing in the direction of the facing relationship less than the thickness of a plate to be straddled by said second legs and a longitudinal spine having said first legs attached at a second end of said first legs to a first side of said spine and said second legs attached at a second end of said second legs to a second side of said spine, said spine, said barbs and said first and second legs being made of an electrically conductive material.

2. A connector as set forth in claim 1 wherein said material is phosphor bronze.

3. A connector as set forth in claim 1 wherein said first group of parallel legs are parallel to said second group of parallel legs.

4. An electrical connector as set forth in claim 1 wherein said spacing of said points of said barbs on said first group of parallel legs is the same as the spacing of said points of said barbs on said second group of parallel legs.

5. A connector as set forth in claim 1 wherein said barbs, said spine and said first and said second legs are integrally formed from said material.

6. A connector as set forth in claim 5 wherein said material is phosphor bronze.

7. A connector as set forth in claim 1 wherein said first and second groups of legs are longitudinally spaced along said spine.

8. A connector as set forth in claim 7 wherein said spacing of said first and second groups of legs along said spine is greater than said spacing of said points of said barbs in said first and second groups of parallel legs.

9. A connector as set forth in claim 7 wherein said first and second groups of legs each include three legs.

10. A connector as set forth in claim 9 wherein two legs of each of said first and second groups of legs are transversely displaced from a center axis of said spine by a first distance and a third leg of each of said first and second groups of legs is transversely displaced from a center axis of said spine by a second distance different from said first distance.

* * * * *